US008950631B2

(12) United States Patent
Langlois

(10) Patent No.: US 8,950,631 B2
(45) Date of Patent: Feb. 10, 2015

(54) SECURING COLLAR AND DISPENSER COMPRISING SUCH A COLLAR

(75) Inventor: Yann Langlois, Tilleul Dame Agnes (FR)

(73) Assignee: Aptar France SAS, Le Neubourg (FR)

( * ) Notice: Subject to any disclaimer, the term of this patent is extended or adjusted under 35 U.S.C. 154(b) by 67 days.

(21) Appl. No.: 13/133,781

(22) PCT Filed: Dec. 10, 2009

(86) PCT No.: PCT/FR2009/052483

§ 371 (c)(1),
(2), (4) Date: Jun. 9, 2011

(87) PCT Pub. No.: WO2010/067031

PCT Pub. Date: Jun. 17, 2010

(65) Prior Publication Data

US 2011/0240679 A1 Oct. 6, 2011

(30) Foreign Application Priority Data

Dec. 12, 2008 (FR) ..... 08 58511

(51) Int. Cl.
*B05B 11/02* (2006.01)
*B05B 11/00* (2006.01)
*B65D 83/20* (2006.01)

(52) U.S. Cl.
CPC ..... *B05B 11/3049* (2013.01); *B05B 11/3047* (2013.01); *B65D 83/205* (2013.01)
USPC ..... 222/153.06; 222/321.7; 222/402.1

(58) Field of Classification Search
CPC ..... B05B 11/3089; B05B 11/3047
USPC ..... 222/153.06–153.08, 321.7, 321.9, 222/402.1; 215/272, 274, 252
See application file for complete search history.

(56) References Cited

U.S. PATENT DOCUMENTS

| | | | | |
|---|---|---|---|---|
| 2,043,243 | A * | 6/1936 | Grauer | 215/252 |
| 3,463,341 | A * | 8/1969 | Fields | 215/252 |
| 4,385,707 | A * | 5/1983 | Leiter | 215/253 |
| 4,746,035 | A * | 5/1988 | Anderson et al. | 222/153.06 |
| 5,799,810 | A * | 9/1998 | de Pous et al. | 215/274 |
| 6,186,359 | B1 * | 2/2001 | de Pous et al. | 222/1 |
| 6,315,169 | B1 | 11/2001 | de Rosa | |
| 2009/0283549 | A1 * | 11/2009 | Beranger | 222/321.7 |

FOREIGN PATENT DOCUMENTS

| | | | |
|---|---|---|---|
| DE | 9218298 | U1 * | 11/1993 |
| FR | 2 764 584 | A1 | 12/1998 |
| FR | 2 808 513 | A1 | 11/2001 |

OTHER PUBLICATIONS

EPO Machine Translation of DE 9218298 U1, 3 pgs.*
International Preliminary Report on Patentability issued on Jun. 14, 2011 for counterpart application PCT/FR2009/052483.

* cited by examiner

*Primary Examiner* — Daniel R Shearer
(74) *Attorney, Agent, or Firm* — Sughrue Mion, PLLC

(57) ABSTRACT

A fastener ring for mounting a dispenser member, such as a pump or a valve, on a neck of a reservoir so as to constitute a fluid dispenser, the ring having a reception device suitable for receiving, in stationary manner, the dispenser member; and a fastener suitable for coming into engagement with the neck. A rupture device is provided between the reception device and the fastener so as to separate the reception device from the fastener, in such a manner as to be able to remove the dispenser member from the reservoir.

14 Claims, 3 Drawing Sheets

SECURING COLLAR AND DISPENSER COMPRISING SUCH A COLLAR

CROSS REFERENCE TO RELATED APPLICATION

This application is a National Stage of International Application No. PCT/FR2009/052483 filed Dec. 10, 2009, claiming priority based on French Patent Application No. 08 58511, filed Dec. 12, 2008, the contents of all of which are incorporated herein by reference in their entirety.

FIELD OF INVENTION

The present invention relates to a fastener device for mounting a dispenser member, such as a pump or a valve, on a neck of a reservoir. In general, the ring includes both reception means that are suitable for receiving, in stationary manner, the pump or the valve, and fastener means that are suitable for coming into engagement with the neck of the reservoir. Such fastener rings are commonly used in the fields of perfumery, cosmetics, or even pharmacy. The present invention also relates to a fluid dispenser that incorporates a reservoir, a pump or a valve, and a fastener ring of the invention.

BACKGROUND

In the prior art, there already exist numerous documents that describe fastener rings for fastening a pump or a valve on a reservoir neck. The fastener means for fastening the ring may use various known techniques, e.g. such as screw-fastening, crimping, snap-fastening, etc. In the snap-fastening technique, there exist two distinct types, namely snap-fastening performed only by the fastener ring, and snap-fastening performed by the fastener ring co-operating with a locking hoop that comes to surround the ring. The crimping and snap-fastening techniques make it possible to provide fastening that is permanent, in the sense that the user does not normally need to remove the pump from the reservoir. The screw-fastening technique provides fastening that is not permanent, enabling the user to unscrew the ring so as to be able to access the inside of the reservoir via the neck. The invention finds an advantageous application with permanent fastener rings, but could also be applied to non-permanent fastener rings if that turns out to be necessary or useful.

Increasingly, it is required to be able to recycle the dispenser, i.e. to be able to separate the various component elements for the purpose of recycling them separately. Naturally, when the fastener ring provides fastening that is permanent (by crimping or by snap-fastening), removing the dispenser is complicated since it requires the fastener ring to be destroyed, which often turns out to be complicated. With screw-fastener rings, the problem exists only in restricted manner, given that it is possible to unscrew the ring from the neck. However, in some applications, it may be desirable to be able to remove the ring without having to unscrew it. Unfortunately, that is not possible with conventional fastener rings that are currently on the market.

CERTAIN OBJECTS OF THE INVENTION

The object of the present invention is to remedy the above-mentioned drawback of the prior art by defining a novel fastener ring that enables the dispenser to be recycled in easy and rapid manner, without needing to increase the number of component parts of the dispenser or needing to complicate the manufacture of the component elements.

To achieve this object, the present invention proposes a fastener ring for mounting a dispenser member, such as a pump or a valve, on a neck of a reservoir so as to constitute a fluid dispenser, the ring comprising:

reception means that are suitable for receiving, in stationary manner, the dispenser member; and fastener means that are suitable for coming into engagement with the neck;

the fastener ring being characterized in that rupture means are provided between the reception means and the fastener means so as to separate the reception means from the fastener means, in such a manner as to be able to remove the dispenser member from the reservoir. While the dispenser is being used, the rupture means fulfill absolutely no function, and even seem to be non-existent. The fastener ring fulfils its first function of intermediate part between the pump or the valve and the neck of the reservoir. The user of the dispenser does not even know that the rupture means are present in the dispenser. In addition, the rupture means are designed in such a manner that an average user, under normal conditions of use, cannot exert the force necessary to cause the rupture means to rupture. Thus, any risk of involuntary or accidental rupture by the user is avoided. However, it is easy to adjust the automatic machine dedicated to rupturing the ring to the force or torque necessary to cause the rupture means to rupture. In other words, for a fastener ring that is fastened in permanent manner (by crimping, by snap-fastening), the permanent character is quite real for the user, but not for the subsequent recycler.

In an advantageous embodiment, the ring includes an annular plate for exerting pressure on the neck, the plate being situated between the reception means and the fastener means, the rupture means being provided between the plate and the fastener means.

According to another advantageous characteristic, a skirt is for coming into engagement with the neck, the fastener means being formed by the skirt, the rupture means being formed by the skirt.

Advantageously, the skirt forms a plurality of tabs that are separated by gaps, rupture means being formed in each tab. The skirt may be an internal skirt for coming into engagement with the inside of the neck, or, in a preferred variant, the skirt may be an external skirt for coming into engagement around the neck.

In another advantageous aspect of the invention, the rupture means are in the form of slots that are disposed in such a manner as to form an annular rupture line. Instead of through slots, it is also possible to imagine one or more grooves making it possible to reduce the wall thickness locally, thereby creating a line of weakness. Whether the rupture means are in the form of slots or of grooves, their purpose is to weaken the ring locally, in such a manner as to impose the location of the rupture and the force necessary to perform the rupture.

When the fastener ring is a snap-fastener ring, such a fastener ring may be associated with an outer hoop that may be a covering hoop, when the ring serves alone to perform a permanent fastening, or a locking hoop that is engaged around the ring so as to lock the fastener means around the neck when the fastener ring is a fastener ring that requires the co-operation of a hoop.

The present invention also defines a fluid dispenser comprising:

a reservoir forming a neck;

a dispenser member, such as a pump or a valve; and a fastener ring as defined above;

the fluid dispenser being characterized in that it is also provided with blocking means for preventing the ring from turning on the neck, so that a torque exerted on the ring, e.g. at its reception means, has the effect of rupturing the rupture means. The embodiment applies more particularly to snap-fastener or crimp-fastener rings, but may also apply to screw-fastener rings, the blocking means for preventing turning thus acting as anti-unscrewing means. The purpose is to prevent the portion of the fastener ring that comes into engagement with the neck from turning, in such a manner as to be able to exert torque on the other portion of the ring so as to cause the rupture means to rupture. By adjusting the design of the rupture means accurately, it is easy to determine accurately the torque necessary to cause the rupture means to rupture. Advantageously, the blocking means are formed between the neck and the fastener means. Preferably, the neck includes a blocking profile, and the ring includes a skirt forming a housing that is suitable for receiving the blocking profile of the neck.

According to another characteristic of the invention, the dispenser may further comprise a locking hoop that is engaged around the ring so as to lock the fastener means around the neck. The hoop thus performs a technical function. In a variant, it is also possible to use a covering hoop that merely fulfils an esthetic function, with a fastener ring serving on its own to provide the fastening.

In another aspect of the invention, the ring comprises a skirt that extends below the rupture means, and a bushing that extends above the rupture means, the hoop being in stronger engagement with the bushing than with the skirt.

In this aspect, rupturing the rupture means makes it possible to separate the tabs individually from the remainder of the ring, thereby making it easier firstly to remove the fastener ring from the neck, and secondly to remove the tabs, given that they are no longer connected together.

The spirit of the present invention is to create controlled weakness at the fastener ring for the benefit, not of the user of the dispenser, but rather of a subsequent operator responsible for recycling, in particular disassembling, the dispenser. This weakness makes it possible to destroy the fastener ring permanently, and thus to remove the pump or the valve from the reservoir.

BRIEF DESCRIPTION OF THE DRAWINGS

The invention is described more fully below with reference to the accompanying drawings which show several embodiments of the invention by way of non-limiting example.

In the figures.

DETAILED DESCRIPTION OF NON-LIMITING EMBODIMENTS

Figure 1:
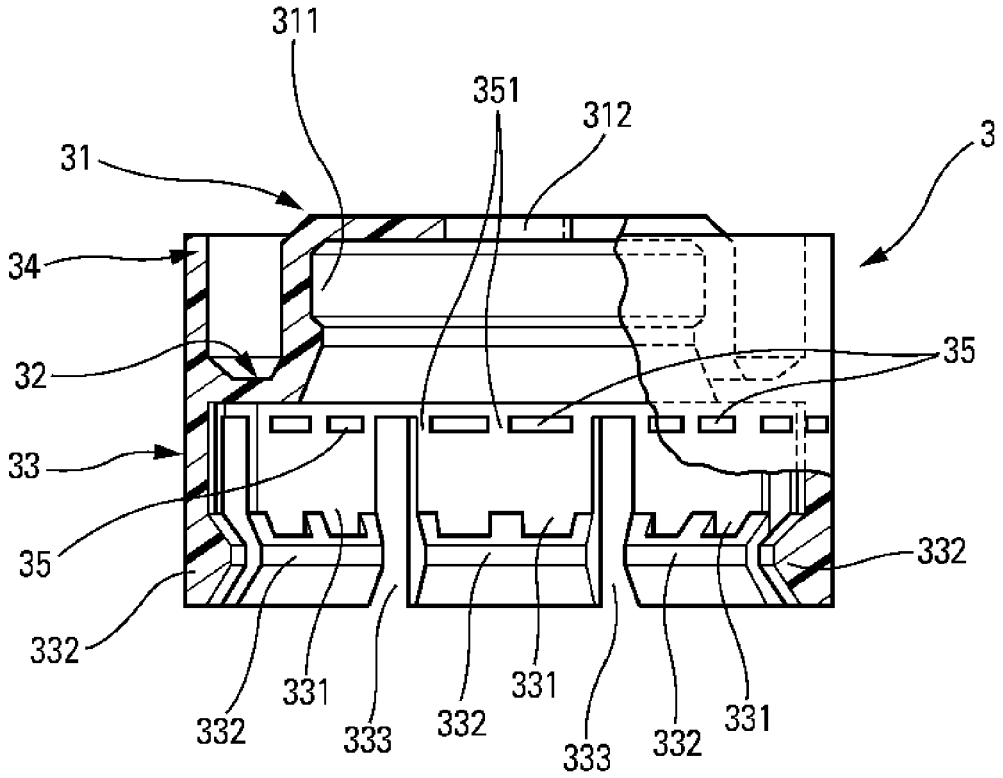
FIG. 1 is a fragmentary section view through a fastener ring in a first embodiment of the invention.

Reference is made firstly to FIG. 1 in order to describe in detail the first embodiment of the invention. The fastener ring 3 may be made by injection molding an appropriate plastics material. In a variant, the ring may also be made of metal. Overall, the ring presents symmetry of revolution about an axis. The ring comprises reception means 31, an annular plate 32, a fastener skirt 33, and a guide bushing 34.

The reception means 31 may be in the form of an annular groove 311 making it possible to receive, advantageously by snap-fastening, a projecting radial collar (not shown) that is formed by a dispenser member, such as a pump or a valve. Receiving the dispenser member in the groove 311 should not only enable the dispenser member to be held in stable manner, but should also enable it to be completely sealed. The reception means 31 also include an axial opening 312 through which there may extend the actuator rod (not shown) of the dispenser member. Instead of the annular snap-fastener groove 311, it is possible to imagine other structures that enable the dispenser member to be fastened in stable and leaktight manner on the ring.

The annular plate 32 extends radially outwards from the outer periphery of the reception means 31. The purpose of the plate 32 is to exert axial pressure on the top annular edge of the neck so as to provide sealing at this point. Conventionally, a neck gasket is interposed between the plate 32 and the top edge of the neck, and the gasket is pressed against the neck by the plate 32.

The fastener skirt 33 extends freely downwards from the outer periphery of the plate 32. The skirt 33 presents a generally substantially cylindrical shape. The major portion of the skirt 33 is formed by tabs 331 that are separated by vertical gaps 333 that open downwards. The bottom ends of the tabs 331 are formed internally with fastener means 332 that may be in the form of one or more inward radial projections, for example. In FIG. 1, the fastener means 332 are in the form of horizontal bars that extend over the entire width of the tabs. Together, the bars form a kind of annular bead that is discontinuous at the gaps 333. As described below, the fastener means 332 are for co-operating with a fastener shoulder formed by the neck of the reservoir.

The guide bushing 34 extends freely upwards from the outer periphery of the plate 32. Advantageously, the bushing 34 extends in alignment with the skirt 33 in such a manner as to co-operate to form a cylindrical outer wall. A purpose of the bushing 34 is to guide a locking hoop (not shown) that is engaged in clamped manner around the cylindrical outer wall of the bushing 34 and of the skirt 33, so as to lock the fastener means 332 in permanent engagement with the neck.

This is an entirely conventional and well known structure for a fastener ring, providing permanent fastening in association with an outer locking hoop. During assembly, the fastener ring 3, already fitted with its pump or with its valve, is engaged on the neck: more precisely, the skirt 33 is engaged around the neck, and to do this, the tabs 331 are deformed radially outwards until the fastener means 332 can at least come to be housed below the shoulder (not shown) of the neck. Then, the locking hoop is lowered around the skirt 33 so as to constrain the fastener means 332 below the shoulder of the neck and lock them in that position. In this way, the ring is fastened in permanent manner on the neck of the reservoir. This is an assembly technique that is entirely conventional and well known in the fields of perfumery, cosmetics, or even pharmacy.

In the invention, the ring 3 is provided with rupture means 35 that make it possible to break it into at least two portions so as to be able to remove the pump or the valve from the reservoir. Advantageously, the rupture means 35 are provided between the fastener means 332 and the reception means 31. By way of example, the rupture means 35 may be provided at the plate 32. In a preferred variant, the rupture means 35 are provided at the skirt 33. In an advantageous embodiment, the rupture means 35 are formed at the top ends of the tabs 331, approximately where the tabs 331 are connected to the remainder of the ring. By way of example, the rupture means 35 may be in the form of elongate through slots 35 that pass through the wall thickness of the tabs. As can be seen in FIG. 1, and by way of example, each tab 331 may be provided with two rectangular slots, allowing three small bridges of material 351 to exist. It can easily be understood that the formation of the slots 35 considerably weakens the connection between the tabs 331 and the remainder of the ring, given that the bridges 351 are weak. Thus, appropriate traction or torque makes it possible to rupture the bridges 351, thereby enabling the tabs 331 to be separated from the remainder of the ring. It should be observed that three bridges of material 351 are formed merely by two slots 35, given that the end bridges are formed in co-operation with the gaps 333. Given the disposition of the slots 35, the rupture of the bridges 351 makes it possible to separate each tab 331 individually, thereby making it easier to remove the dispenser. In addition, given that the tabs 331 are separated, they do not remain in place around the neck, which would otherwise require an additional operation.

Instead of slots 35, it is also possible to imagine other embodiments for the rupture means. The rupture means may be made in the form of one or more grooves enabling the wall thickness of the ring to be reduced locally. The grooves may be considered as blind slots.

In use, the FIG. 1 fastener ring 3 is associated with a locking hoop (not shown). The traction force or the turning torque may thus be applied to the hoop at the guide bushing 34.

Figure 2:
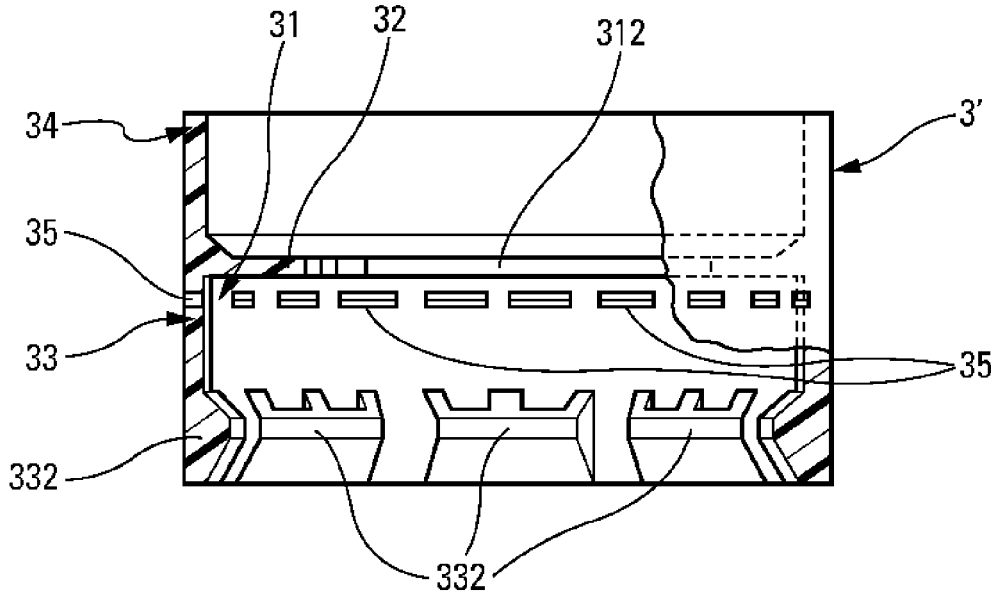
FIG. 2 is a view similar to the view in FIG. 1 in a second embodiment of the invention.

FIG. 2 shows a second embodiment for a fastener ring of the invention. The fastener ring, designated 3', presents a design that is simpler than the design in FIG. 1. The ring 3' includes an annular plate 32 that defines a central opening 312 through which the actuator rod of the pump or the valve can pass. The reception means 31 do not present a special configuration and they are situated just below the plate 32 that has the function of jamming a projecting collar of the pump or the valve on the top edge of the neck. The collar may act as a neck gasket. Just like in the above-described embodiment, the ring 3' includes a guide bushing 34 that extends freely upwards from the outer periphery of the plate 32. The ring 3' also forms a fastener skirt 33 that extends freely downwards from the outer periphery of the plate 32. The skirt 33 internally forms fastener means 332 that may present a design that is substantially similar to the design in FIG. 1. However, unlike the FIG. 1 skirt 33, the skirt of the ring 3' is not formed with tabs separated by gaps, but, on the contrary, it is continuous over its entire periphery. Thus, the skirt 33 presents a smaller capacity to deform, but, in contrast, serves alone to provide fastening that is permanent, without the help of an additional locking hoop. However, a covering hoop may be used to improve the appearance by masking the ring 3'.

The fastener ring 3' includes rupture means 35 that may be in the form of recesses for example, i.e. blind slots. The recesses locally reduce the wall thickness of the skirt 33, thereby creating a line of weakness in traction or in shear. The recesses extend over the entire internal periphery of the skirt 33 in such a manner as to co-operate to create an annular rupture line. By exerting appropriate traction or torque, e.g. at the bushing 34, the skirt 33 may be separated from the remainder of the ring. However, the skirt 33 remains in position around the neck, and an additional operation is required for cutting or pulling off the skirt 33.

Figure 3:
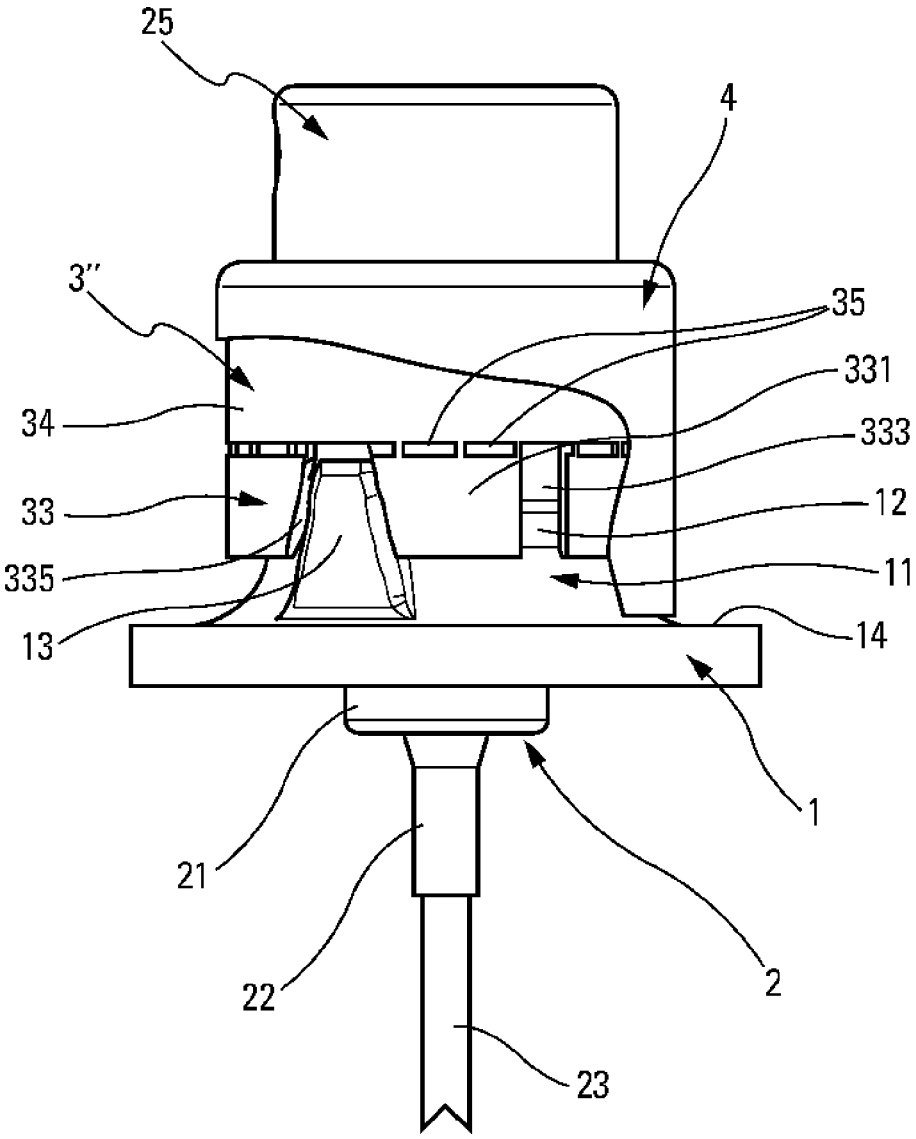
FIG. 3 is a view partially from the front and partially in section, of a portion of a dispenser using a fastener ring in a third embodiment of the invention.
Figure 5:
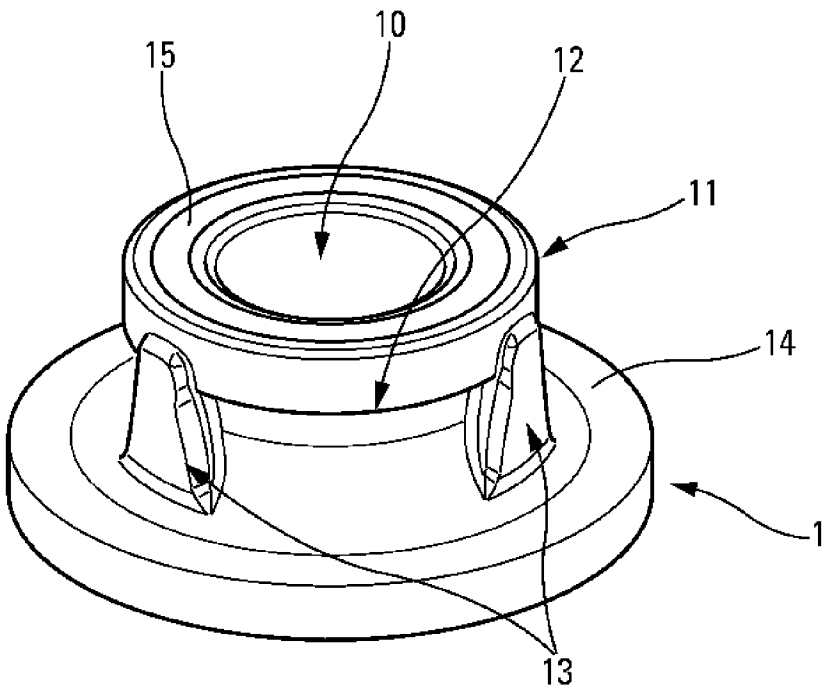
FIG. 5 is a perspective view of the top portion of the reservoir incorporating the neck that is used in the FIG. 3 dispenser.
Figure 4:
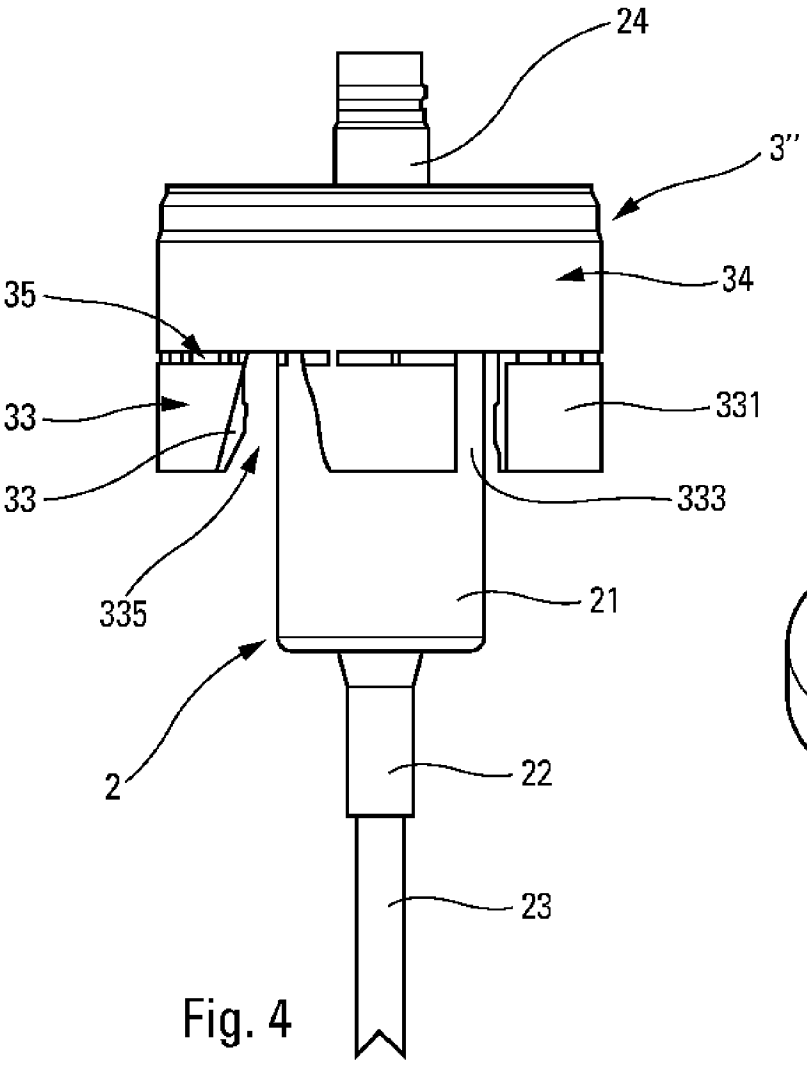
FIG. 4 is a side view of the fastener ring and of the FIG. 3 dispenser member.

Reference is made below to FIGS. 3 to 5 in order to explain a preferred embodiment. FIG. 3 shows a fluid dispenser having a reservoir 1 that is shown only in part. Only the top portion of the reservoir 1 can be seen, forming a neck 11 that is provided with an outer shoulder 12 and with a plurality of blocking profiles 13 for preventing turning. Conventionally, the neck 11 defines an opening 10 enabling the inside of the reservoir to communicate with the with the outside thereof. This can be seen in FIG. 5. The shoulder 12 serves as a fastener profile for co-operating with the fastener means 332 of the ring 3". The shoulder 12 extends around the entire outer periphery of the neck 11 and is directed downwards. It can thus be said that the fastener means come into engagement below the shoulder 12. Advantageously, the blocking profiles 13 are distributed in equidistant manner around the neck. The profiles 13 extend upwards from the body 14 of the reservoir so as to reach as far as the shoulder 12. The profiles 13 even project radially outwards relative to the shoulder 12. Each profile 13 presents a shape that is substantially trapezoidal. The top end of the profile 13 does not extend as far as the annular top edge 15 of the neck. The outer surface of the profile 13 is substantially vertical. The reservoir 1 may be made of glass or of plastics material.

The fastener ring 3" presents a design that is substantially similar to the design of the first embodiment. The skirt 33 forms tabs 331 that are separated by gaps 333. The rupture means 35 are formed at the top ends of the tabs 331 where said tabs join the remainder of the ring. Although not shown, the ring 3" includes reception means making it possible to receive, e.g. by snap-fastening, a dispenser member 2 that comprises a body 21, a fluid inlet 22, a dip tube 23, and a pusher 25. In FIG. 4, it can also be seen that the dispenser member 2 further comprises an actuator rod 24 on which the pusher 25 is mounted.

In order to block the tabs 331 below the shoulder 12 of the neck, there is provided a locking hoop 4 that is engaged in clamping contact around the ring 3" so as to force and block the fastener means 332 below the shoulder 12. By way of example, the locking hoop 4 may be made of metal.

In this particular embodiment, the fastener ring 3" includes a plurality of housings 335 that are formed between two adjacent tabs 331. The housing 335 may be considered as a special gap given that it separates two tabs. This is clearly visible in FIG. 3 and FIG. 4. The housing 335 extends as far as the rupture means 35. In the invention, while mounting the ring on the neck, the housings 335 are for receiving the turn-preventing blocking profiles 13 formed by the neck. This can be seen in FIG. 3. As a result of their advantageous trapezoidal shape, the profiles 13 engage easily into the respective housings 335 that also present a corresponding trapezoidal shape. The profiles 13 fill the housings 335 in such a manner that the tabs 331 can no longer turn around the neck. Engaging the locking hoop 4 around the ring makes it possible to mask the tabs and also the profiles 13. Thus, to the user, the profiles 13 are not visible. In contrast, for the operator responsible for recycling the dispenser, the profiles 13 engaged in the housings 335 enable torque to be exerted on the hoop 4 by holding it at the guide bushing 34, for example. The torque makes it possible to rupture the rupture means 35, given that the tabs 331 are prevented from turning by the blocking profiles 13.

Preferably, the hoop is in stronger engagement with, or bears more strongly against, the bushing 34 than the skirt 33. Thus, the hoop is secured more strongly to the bushing than to the skirt, and since the bushing is kept separate from the skirt by the rupture means 35, a traction and/or turning force exerted on the hoop acts mainly or preferably on the bushing, thereby leading to stress on the rupture means, which finally break.

Instead of turn-preventing blocking profiles 13, it is possible to imagine any equivalent means that make it possible to prevent the ring from turning on the neck. For a screw-fastener ring, it is possible to imagine that the turn-preventing blocking profiles are in the form of notches that enable screw engagement, but that prevent the ring from being unscrewed in any way.

By means of the present invention, it is possible to remove a fluid dispenser quickly and cleanly, whether the fastener ring is mounted in permanent or non-permanent manner.

The invention claimed is:

1. A fluid dispenser comprising:
a reservoir forming a neck;
a dispenser member; and
a fastener ring for mounting the dispenser member on the neck of a reservoir, the fastener ring comprising:
reception means for receiving, in stationary manner, the dispenser member; and
fastener means for coming into engagement with the neck;
rupture means are provided between the reception means and the fastener means so as to separate the reception means from the fastener means, in such a manner as to be able to remove the dispenser member from the reservoir; and
wherein the fastener means are located entirely below the rupture means, so that following rupture of the rupture means, the dispenser member is no longer secured to the neck and the fastener ring is permanently destroyed; and separated from the neck and;
wherein the fluid dispenser is also provided with blocking means for preventing the ring from turning on the neck, so that a torque exerted on the ring has the effect of rupturing the rupture means.

2. A fluid dispenser according to claim 1, wherein the blocking means are formed between the neck and the fastener means.

3. A fluid dispenser according to claim 2, wherein the neck includes a blocking profile, and the ring includes a skirt forming a housing that is suitable for receiving the blocking profile of the neck.

4. A fluid dispenser according to claim 1, further comprising a locking hoop that is engaged around the ring so as to lock the fastener means around the neck.

5. A fluid dispenser according to claim 4, wherein the ring comprises a skirt that extends below the rupture means, and a bushing that extends above the rupture means, the hoop being in stronger engagement with the bushing than with the skirt.

6. The fluid dispenser according to claim 1, wherein the dispenser member is a pump or a valve.

7. The dispenser according to claim 1, wherein the fastener ring comprises an annular plate for exerting pressure on the neck, the plate being situated between the reception means and the fastener means, the rupture means being provided between the plate and the fastener means.

8. The dispenser according to claim 1, wherein the fastener ring comprises a skirt for coming into engagement with the neck, the fastener means being formed by the skirt, the rupture means being formed by the skirt.

9. The dispenser according to claim 8, wherein the skirt forms a plurality of tabs that are separated by gaps, rupture means being formed in each tab.

10. The dispenser according to claim 1, wherein the rupture means are in the form of slots that are disposed in such a manner as to form an annular rupture line.

11. A fluid dispenser comprising:
a reservoir comprising a neck;
a dispenser member configured to dispense fluid from the reservoir;
a fastener ring that mounts the dispenser member on the neck of a reservoir, the fastener ring comprising:
a cavity in which the dispenser member is secured;
tabs, each tab comprising a radial projection that engages the neck to thereby fasten the fastener ring to the neck; and
weakened portions provided between the cavity and the radial projections configured to be ruptured so as to separate the cavity from the radial projections and thereby allow removal of the dispenser member from the reservoir;
the fluid dispenser further comprising an upwardly extending profile positioned between two of the tabs and configured to prevent the fastener ring from turning about the neck, so that a torque exerted on the ring causes the rupture of the weakened portions; and
wherein the radial projections are located entirely below the weakened portions, so that following rupture of the weakened portions, the tabs are separated from the remainder of the fastener ring and the neck so that the dispenser member is no longer secured to the neck and the fastener ring is permanently destroyed.

12. The fluid dispenser according to claim 11, wherein the tabs extends axially, the fluid dispenser further comprising a removable hoop that is slid over the tabs so as to prevent the tabs from splaying radially outwards.

13. The fluid dispenser according to claim 11, wherein the dispenser member comprises a pusher configured to be pushed by a user to actuate the dispenser member and wherein the pusher extends beyond the fastening ring so as to be accessible by the user while the fastener ring maintains the dispenser member mounted on the neck of a reservoir.

14. A fluid dispenser comprising:
a reservoir comprising a neck;
a dispenser member configured to dispense fluid from the reservoir;
a fastener ring that mounts the dispenser member on the neck of a reservoir, the fastener ring comprising:
a cavity in which the dispenser member is secured;
tabs, each tab comprising a radial projection that engages the neck to thereby fasten the fastener ring to the neck; and
weakened portions provided between the cavity and the radial projections configured to be ruptured so as to separate the cavity from the radial projections and thereby allow removal of the dispenser member from the reservoir;
the fluid dispenser further comprising an upwardly extending profile positioned between two of the tabs and configured to prevent the fastener ring from turning about the neck, so that a torque exerted on the ring causes the rupture of the weakened portions, and wherein the upwardly extending profile is disposed entirely below the weakened portions; and
wherein the radial projections are located entirely below the weakened portions, so that following rupture of the weakened portions, the tabs are separated from the remainder of the fastener ring and the neck so that the dispenser member is no longer secured to the neck and the fastener ring is permanently destroyed.

* * * * *